US005615741A

United States Patent [19]

Coronado

[11] Patent Number: 5,615,741

[45] Date of Patent: Apr. 1, 1997

[54] PACKER INFLATION SYSTEM

[75] Inventor: Martin P. Coronado, Houston, Tex.

[73] Assignee: Baker Hughes Incorporated, Houston, Tex.

[21] Appl. No.: 380,973

[22] Filed: Jan. 31, 1995

[51] Int. Cl.[6] ..... E21B 33/127

[52] U.S. Cl. ..... 166/387; 166/187

[58] Field of Search ..... 166/387, 186, 166/187

[56] References Cited

U.S. PATENT DOCUMENTS

| | | | |
|---|---|---|---|
| 2,710,656 | 6/1955 | Springer . | |
| 2,970,649 | 2/1961 | Brown . | |
| 3,119,450 | 1/1964 | Evans . | |
| 3,169,580 | 2/1965 | Bateman . | |
| 3,396,798 | 8/1968 | Burns et al. . | |
| 3,606,924 | 9/1971 | Malone | 166/187 |
| 3,648,777 | 3/1972 | Arterbury et al. . | |
| 4,027,732 | 6/1977 | Perkins . | |
| 4,279,306 | 7/1981 | Weitz | 166/312 |
| 4,714,117 | 12/1987 | Dech | 166/380 |
| 4,815,538 | 3/1989 | Burroughs | 166/312 |
| 4,869,325 | 9/1989 | Halbardier | 166/387 |
| 5,044,444 | 9/1991 | Gronado | 166/387 |
| 5,082,062 | 1/1992 | Wood et al. . | |
| 5,186,258 | 2/1993 | Wood et al. . | |
| 5,366,019 | 11/1994 | Brooks | 166/387 |
| 5,375,662 | 12/1994 | Echols, III et al. | 166/386 |
| 5,396,954 | 3/1995 | Brooks | 166/187 |

FOREIGN PATENT DOCUMENTS

618343A2 10/1994 European Pat. Off. .

OTHER PUBLICATIONS

Horizontal Inflation Tool (HIT), Long, Cement Inflatable Formation Packers; CTC International HIT Assembly Manual, not dated.

*Primary Examiner*—Hoang C. Dang
*Attorney, Agent, or Firm*—Rosenblatt & Redano, P.C.

[57] ABSTRACT

An inflation tool for an external casing packer (ECP) is provided. It allows isolation of each ECP and inflation with mud, cement, or other fluids. The opening for the ECP is isolated by appropriate seals, while a passage in the inflation tool is closed off by a plug which allows internal fluid pressure build-up. A sliding sleeve valve is responsive to built-up pressure and opens to allow access to the ECP. Upon complete inflation of the ECP, the pressure applied is removed, allowing the sleeve to close and the pressure between the seals surrounding the opening to the ECP is equalized with the wellbore. Excess mud or other inflation material can be reversed out by a bypass feature around the plug. A pressure-relief feature in the inflation tool allows further pressure equalization for the string, which was used to run the tool in the hole, to facilitate its removal.

24 Claims, 17 Drawing Sheets

PACKER INFLATION SYSTEM

FIELD OF THE INVENTION

The field of this invention relates to packers, particularly external casing packers, and techniques and devices for inflating them, particularly when in use with slotted casing or liners.

BACKGROUND OF THE INVENTION

In the past, typical completions would involve a casing which is run in the wellbore and cemented. The wellbore thereafter is extended and a casing or liner is suspended to the uphole casing which had earlier been cemented. Typically, liner hangers were used to suspend the lowermost portion of the casing or liner which is added, generally in a deviated wellbore. These lower casings typically involve the use of openings or slots extending into the horizontal segment of the wellbore. Typically, the slotted casing or liner was run with external packers; hence, the term ECP (external casing packer). In view of the openings or slots in the liner supporting the ECPs, internal mud or cement pressure could not be used within such liners to inflate the ECPs disposed along the length of the liner. Instead, each ECP had to be isolated so that it could then be actuated to expand into contact with the wellbore, isolating the desired zones of slotted casing. Prior designs have been developed to isolate each specific ECP and allow it to be inflated with mud or cement. Such prior designs are illustrated in U.S. Pat. No. 5,082,062. This patent, entitled "Horizontal Inflatable Tool," refers to a tool manufactured by CTC Corporation of Houston, Tex. This tool involved a concept of isolation of an ECP, using an inner workstring, followed by a series of mechanical operations to begin the inflating operation. The problem with prior design tools is that in deviated wellbores, it is difficult to communicate mechanical movement from the surface and know that, reliably, such movement has been translated to an equal amount or degree of movement at the desired location. Hence, the prior systems added a degree of unreliability to the inflation procedure for the ECPs, thus creating uncertainty as to whether each of the ECPs, as desired, had been fully inflated.

The apparatus and method of the present invention provide greater reliability in knowing that the ECP has been properly inflated. Reliability is further enhanced by the hydraulic rather than mechanical operation. Reliability is built into the system through a variety of features which ensure, through pressure-equalizing techniques, the longevity of the seals around the opening for each ECP. Additionally, a provision has been made to allow removal of any excess cement by a reversing procedure. Finally, to minimize the effort required to remove the inflating tool out of the hole, other relief provisions have been incorporated into the design to facilitate pulling out of the hole.

SUMMARY OF THE INVENTION

An inflation tool for an external casing packer (ECP) is provided. It allows isolation of each ECP and inflation with mud, cement, or other fluids. The opening for the ECP is isolated by appropriate seals, while a passage in the inflation tool is closed off by a plug which allows internal fluid pressure build-up. A sliding sleeve valve is responsive to built-up pressure and opens to allow access to the ECP. Upon complete inflation of the ECP, the pressure applied is removed, allowing the sleeve to close and the pressure between the seals surrounding the opening to the ECP is equalized with the wellbore. Excess mud or other inflation material can be reversed out by a bypass feature around the plug. A pressure-relief feature in the inflation tool allows further pressure equalization for the string, which was used to run the tool in the hole, to facilitate its removal.

DETAILED DESCRIPTION OF THE PREFERRED EMBODIMENT

Figure 1:
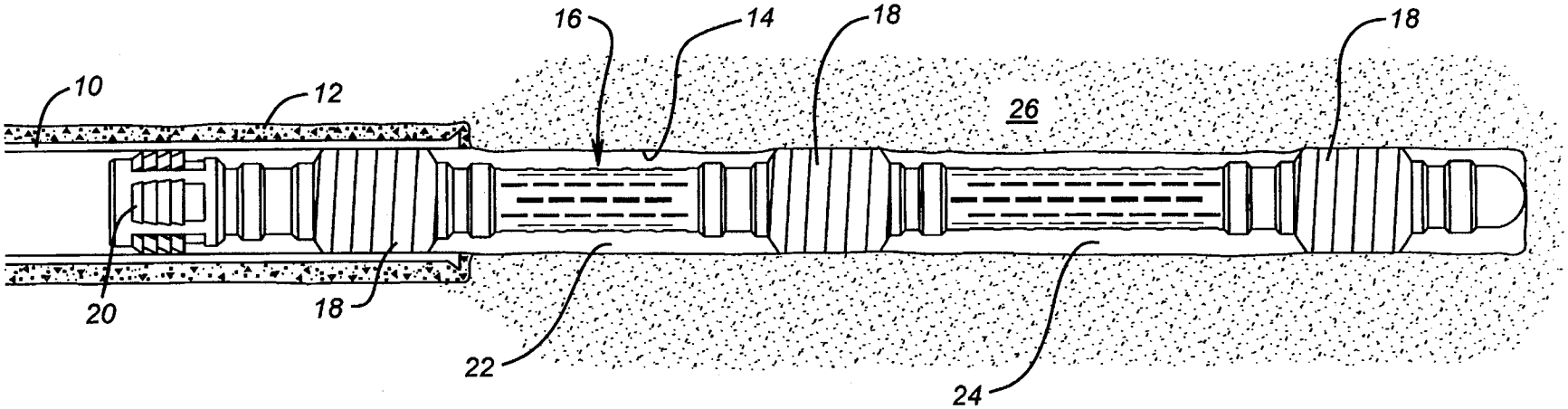
FIG. 1 illustrates the use of a slotted liner in combination with ECPs.
Figure 3A:
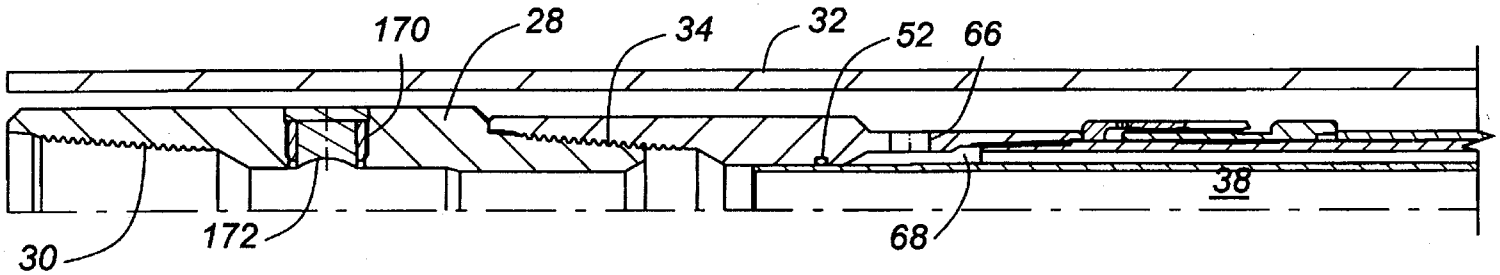
FIGS. 3*a–e* are the view of FIG. 2, showing the tool properly positioned inside an ECP opening prior to inflation.

FIG. 1 illustrates the typical situation involving the use of the apparatus A of the present invention. Initially, a wellbore 14 is drilled and a liner 10 is secured in position with cement 12. Thereafter, the wellbore 14 is further extended beyond the end of liner 10. Typically, in horizontal completions, a slotted liner 16 is run into the wellbore 14 with a plurality of external casing packers or ECPs 18. The slotted liner assembly 16 is typically secured to liner 10 with liner hanger 20, a device well-known in the art. Those skilled in the art will readily appreciate that the annular spaces 22 and 24 in this type of an operation am in communication with the formation 26, thereby precluding the use of applied pressure within the slotted liner 16 to inflate the ECPs 18. Pressure applied within the interior of the slotted liner 16 will communicate undesirable pressure applied to the formation 26. Accordingly, it is desirable to isolate each ECP 18 for selected inflation. The apparatus and method illustrated in FIGS. 2–7 illustrates how to accomplish selective filling of the ECPs 18 using fluid pressure.

Referring now to FIG. 2, the apparatus A of the present invention is illustrated in the position of running in the hole to the first ECP 18. The apparatus A has a top sub 28 which has a thread 30 to which a string or coiled tubing can be connected to allow running the apparatus A into the desired depth from the surface. An outer top sleeve 32 is connected by thread 34 to top sub 28. Sleeve 32 works in conjunction with sleeve 36 (see FIG. 1*d*) to retain an assembly of seals as will be described below. Located internally of outer top sub 32 and outer bottom sub 36 is a tubular passage 38, which is defined by a series of attached tubular members 40–50. It can be seen that tubular member 40 is sealingly engaged to top outer sleeve 32 by virtue of seal 52, while at the other end of passage 38, seal 54 provides the seal between tube 50 and outer bottom sub 36.

A lateral port 56 extends radially from passageway 38 into variable-volume cavity 58. Seals 60 and 62 seal off variable-volume cavity 58 such that upon pressure build-up therein, movement of piston 64 occurs, as seen by comparing FIGS. 3 and 4.

A bypass flow passage 68 exists throughout the tool and begins at lateral port 66. The bypass or equalizing passage 68 is marked throughout FIG. 2. At its lower end as shown in FIG. 2*d*, a lateral port 70 allows the bypass passage 68 to emerge downhole from the sealing assemblies which will be later described.

Returning now to piston 64, it can be seen that the piston 64 is biased by a stack of Belleville washers 72 into the closed position as shown in FIG. 2. While Belleville washers are illustrated as the biasing mechanism, other mechanisms, such as springs, pressure imbalances due to piston configurations, can also be used to bias the piston 64 into the position shown in FIG. 2 without departing from the spirit of the invention. The washers 72 are located in a compartment 74 which is open to the bypass passage 68 through one or more lateral openings 76. Thus, when the washers 72 are compressed as shown in FIG. 4, the reduced volume of compartment 74 results in fluid displacement through lateral passages 76 and into the bypass passage 68. Those skilled in the art will appreciate that the fluid displacement feature of passages 76 allow the washers 72 to compress when subjected to movement of piston 64 due to pressure build-up in cavity 58.

Figure 2A:
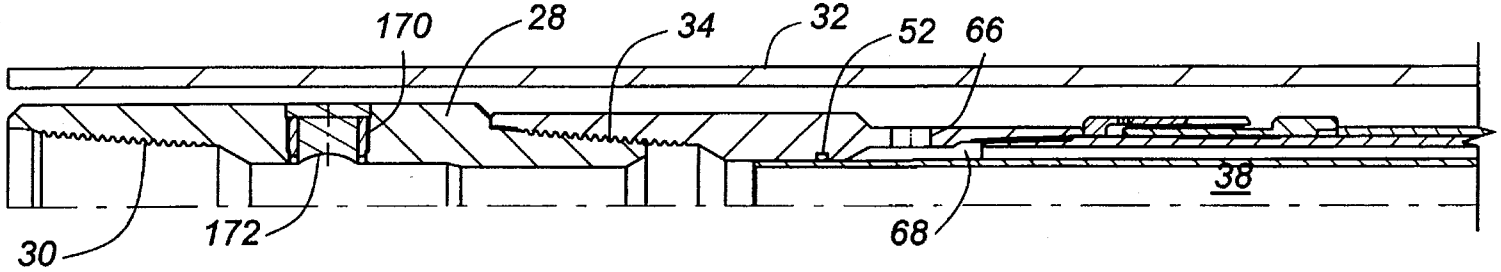
FIGS. 2*a–e* are a sectional elevational view of the inflation tool in the run-in position.
Figure 2B:
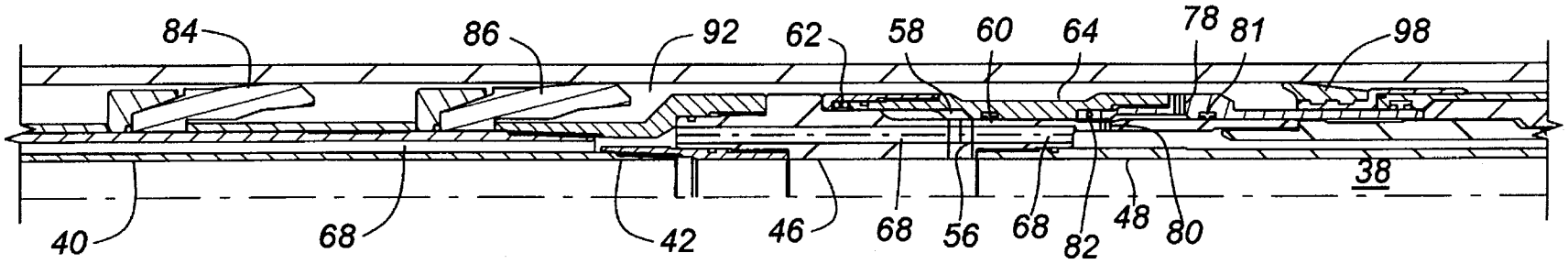
Figure 3B:
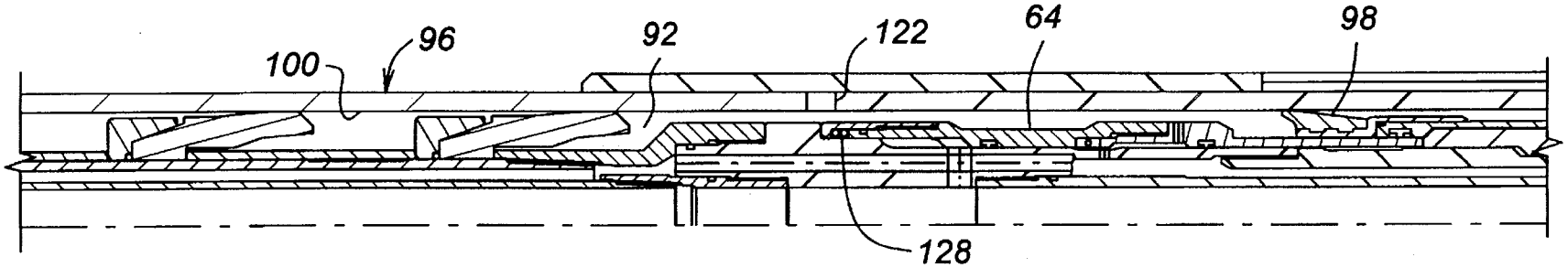
Figure 2C:
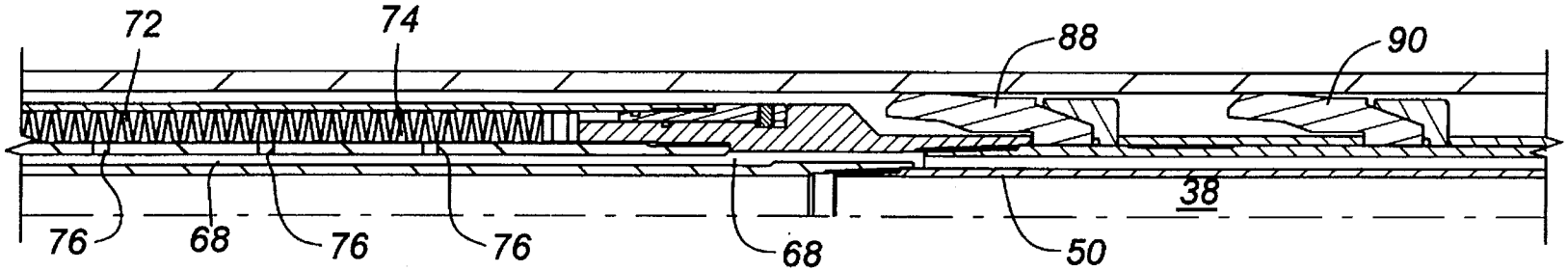
Figure 3C:
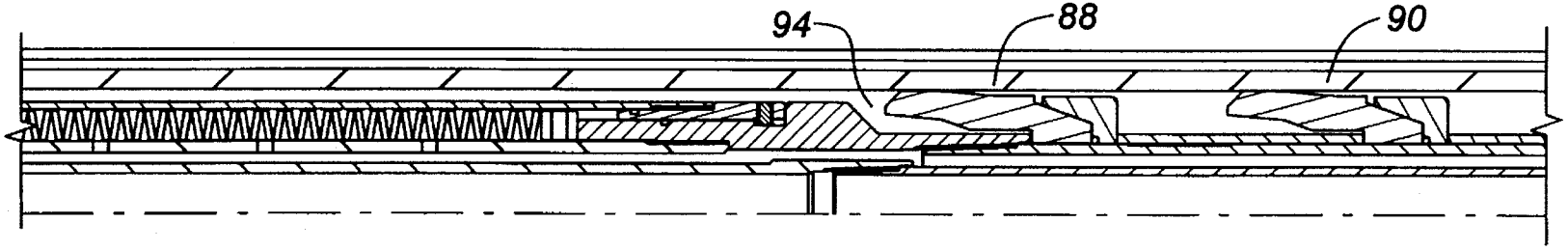
Figure 2D:
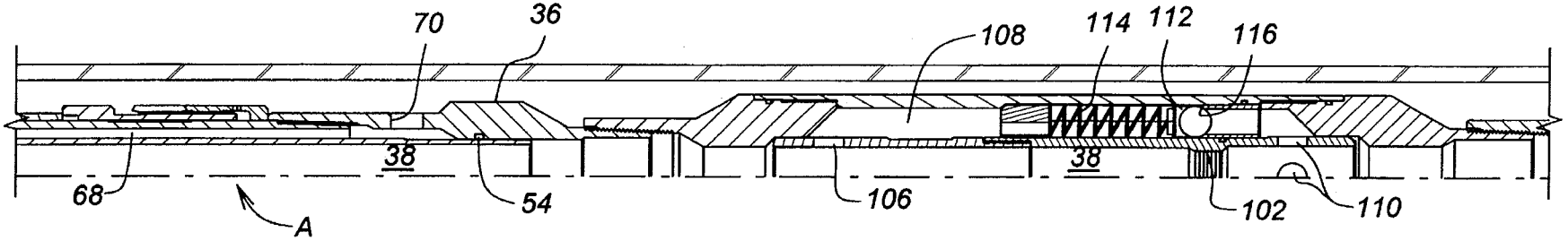
Figure 3D:
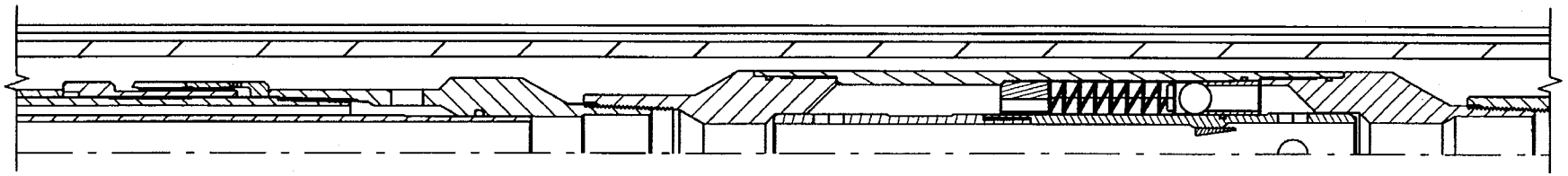

As shown in FIG. 2*b*, the piston 64 has a bypass passage 78 which communicates through passage 80 into bypass passage 68 in the position shown in FIG. 2. Seals 60 and 81 sealingly isolate passage 78 to channel it into passage 80 and ultimately into the bypass passage 68 during the run-in position. A seal 82 is also mounted to piston 64 for ultimate isolation of passage 80 from passage 78, as will be described below.

The sealing assembly comprises upper cup seals 84 and 86, which are retained in a conventional manner. It is to be noted that while cup seals 84 and 86 are illustrated in the preferred embodiment that other types of seals can be used without departing from the spirit of the invention. Oriented in a reverse manner and mounted closer to outer bottom sub 36 are seals 88 and 90, which in the preferred embodiment are identical to seals 84 and 86. Again, seals 88 and 90 are retained in the customary manner known in the art. Seals 86 and 88 define annular spaces 92 and 94 between the apparatus A and the ECP body 96 (see FIG. 3*b*). Annular spaces 92 and 94 are separated by a wiper 98. Wiper 98 helps to reduce the size of annular space 92 which will fill up with cement or other fluid during the inflation procedure.

Figure 6A:
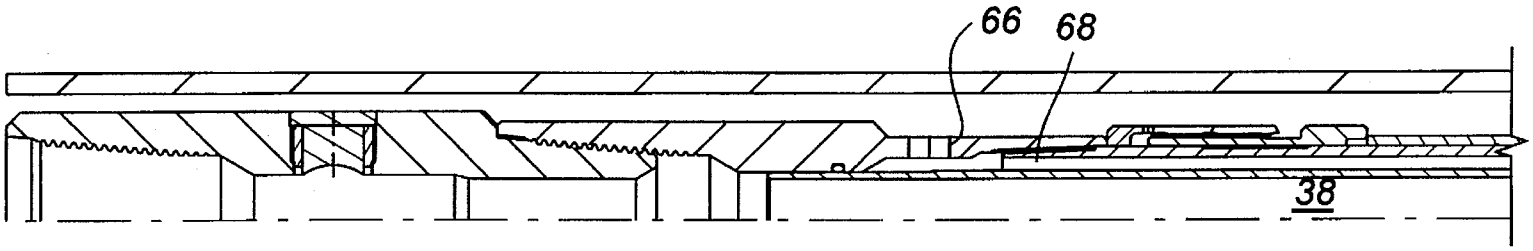
FIGS. 6*a–e* illustrate the reversing out procedure after inflation of all ECPs.
Figure 6B:
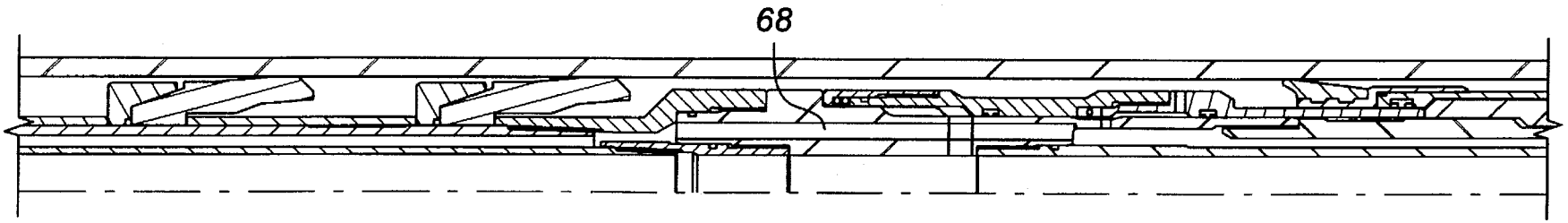
Figure 6C:
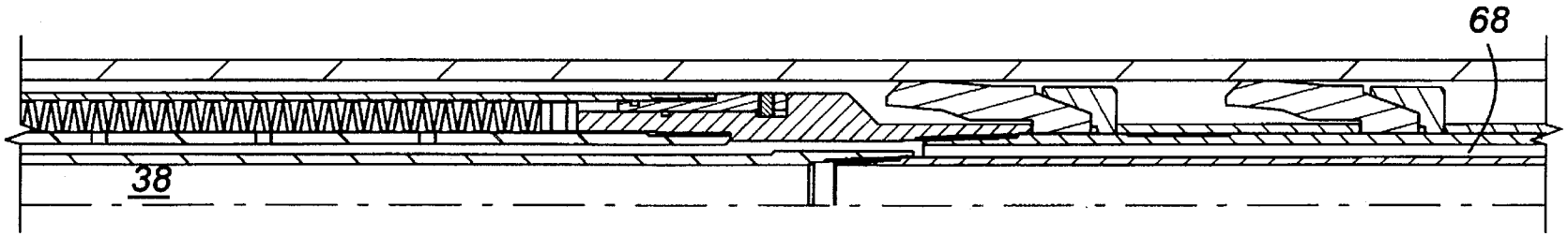
Figure 6D:
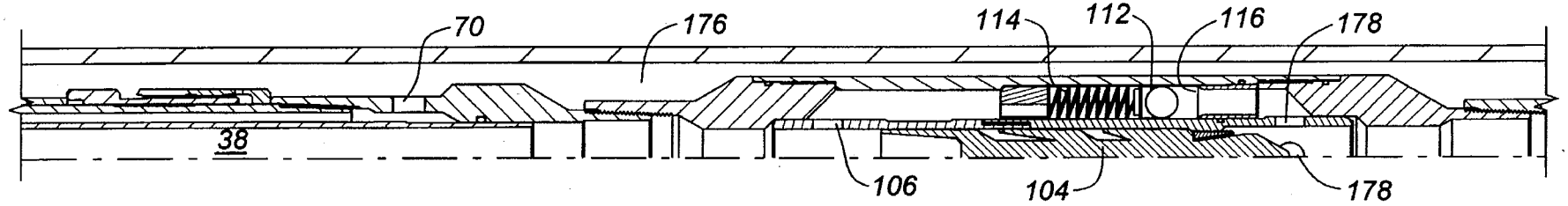
Figure 7D:
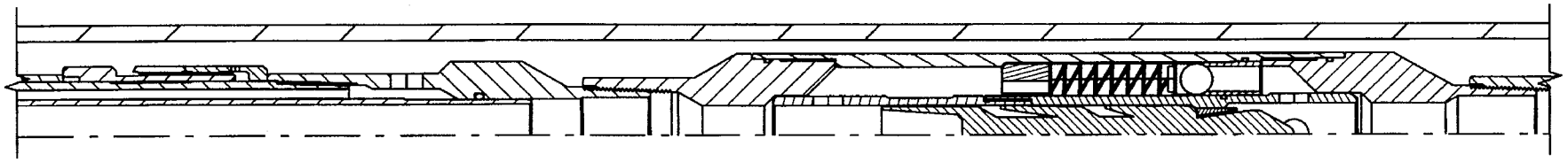
Figure 6E:
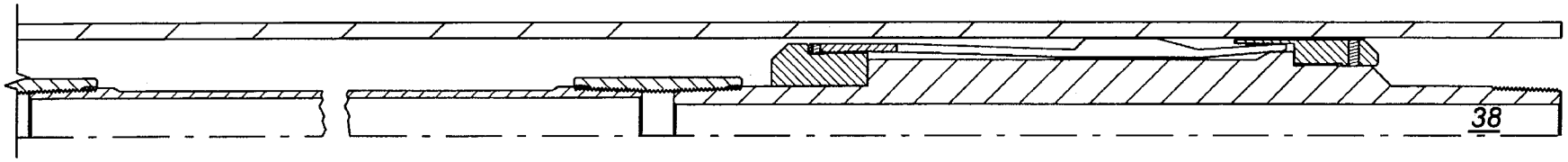
Figure 7E:
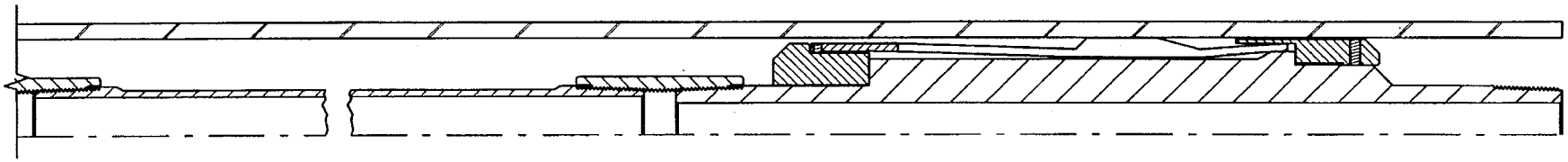

Seals 84–90 and wiper 98 are preferably made of nitrile rubber 90 Durometer. As shown in FIG. 2d, passage 38 has a plurality of teeth 102, or other devices known in the art, for ultimately catching and retaining a wiper plug 104 (see FIG. 4*d*). When a wiper plug 104 is engaged sealingly in passage 38 to teeth 102, pressure can be built up in passage 38. A lateral port 106 (see FIG. 2*d*) extends into a bypass passage 108. Passage 108 reconnects to passage 38 at lateral port 110. A plurality of balls 112, biased by springs 114 against seats 116, allow the pressure in passage 38 to be retained by not letting it escape through bypass passage 108 due to ball 112 being seated against seat 116. However, when the pressure is applied in the opposite direction into passage 108 after the wiper plug 104 is sealingly blocking passage 38, reverse flow is possible due to compression of spring 114, as shown in FIG. 6*d*. This procedure will be explained below.

Figure 2E:
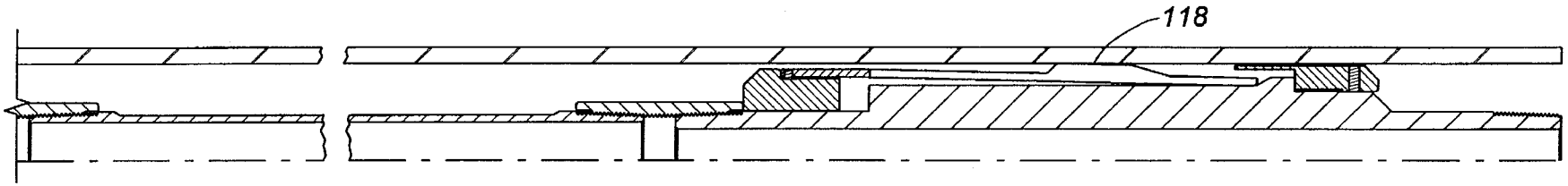
Figure 3E:
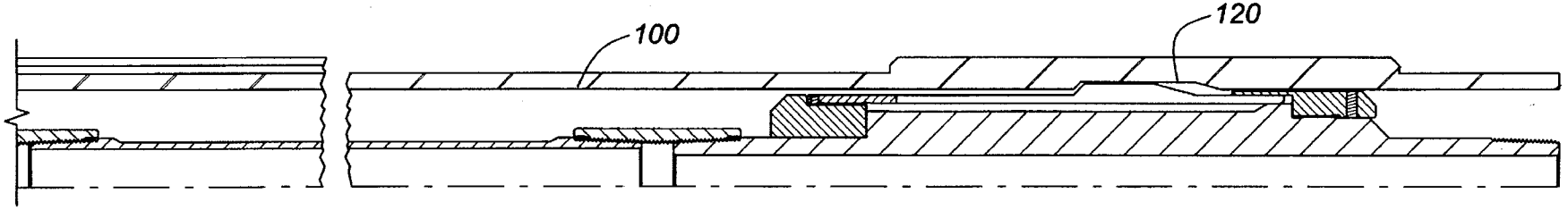
Figure 4A:
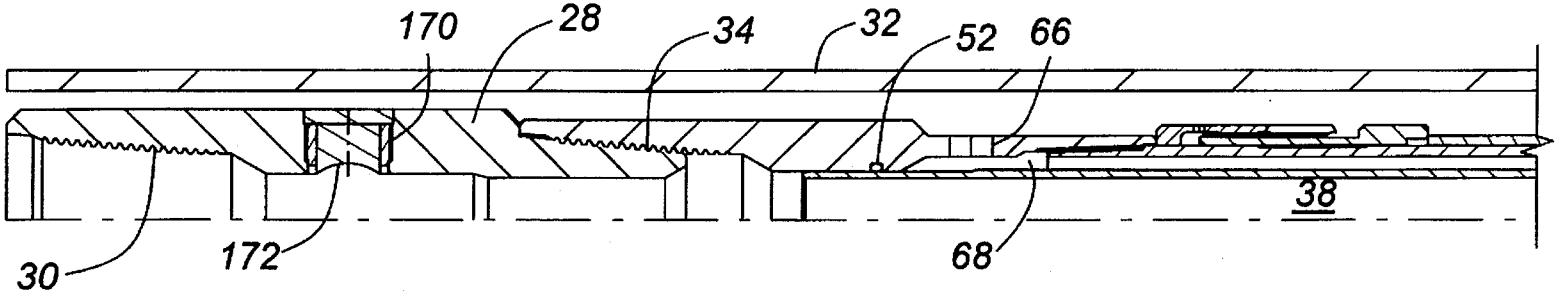
FIGS. 4*a–e* are the view of FIG. 2, shown after landing the plug and applying fluid pressure to inflate the ECP.
Figure 5A:
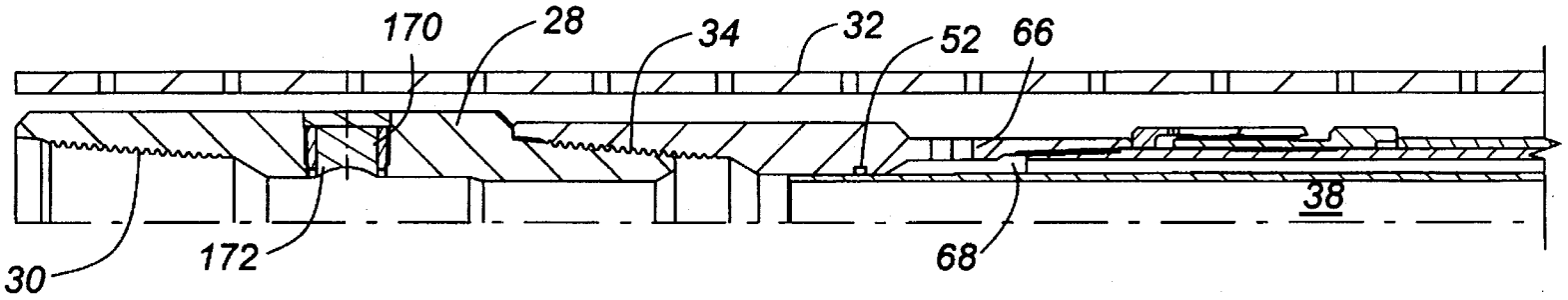
FIGS. 5*a–e* illustrate the movement of the tool from one ECP to another after inflation of the first ECP.
Figure 4B:
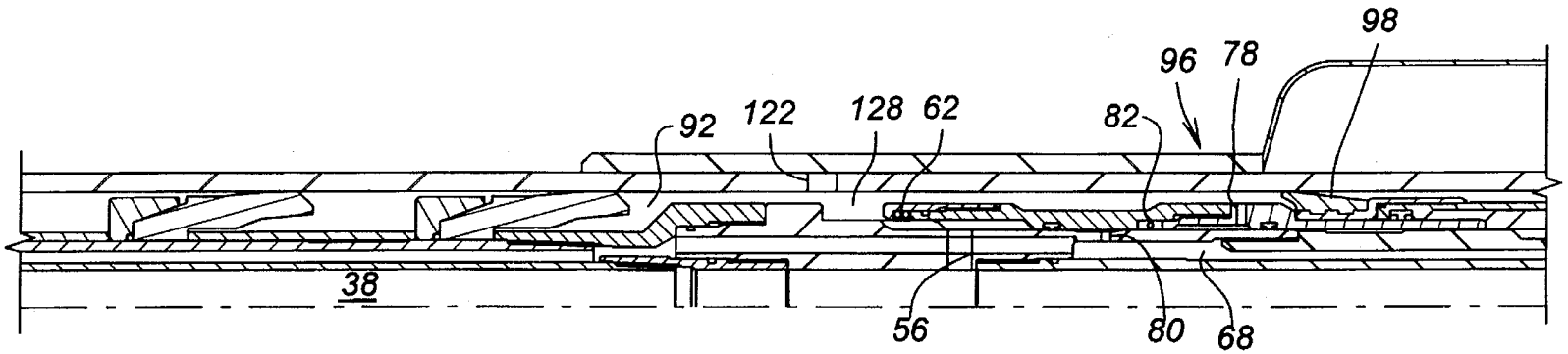
Figure 5B:
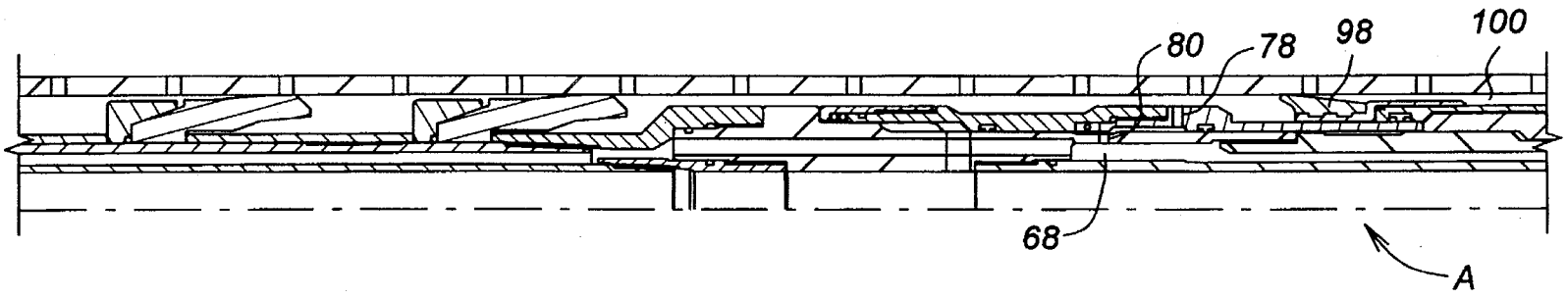
Figure 4C:
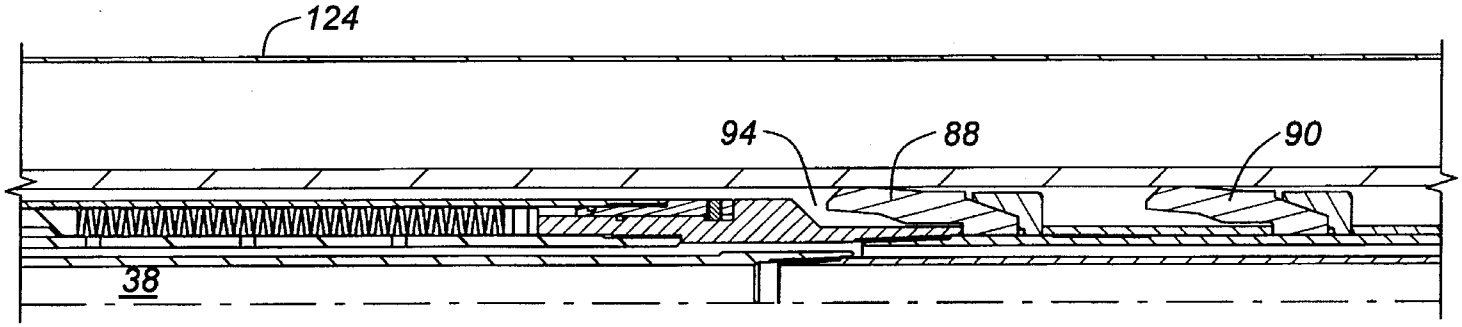
Figure 5C:
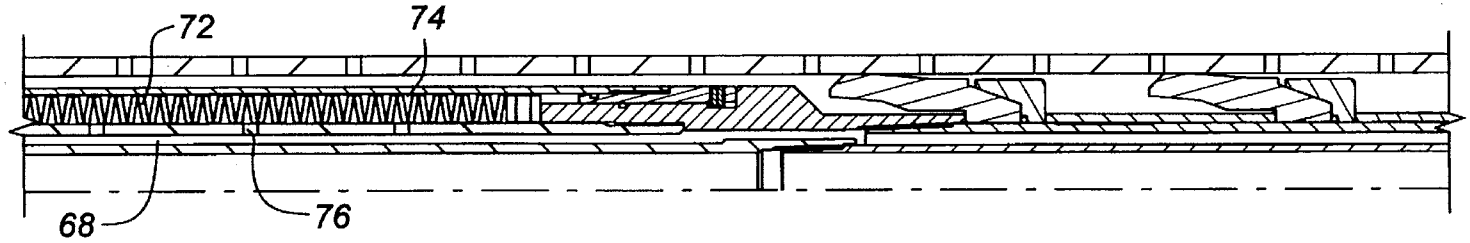
Figure 4D:
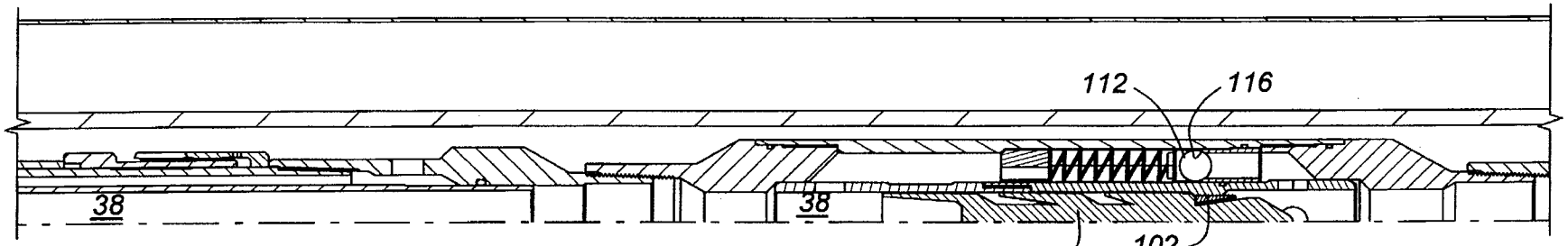
Figure 5D:
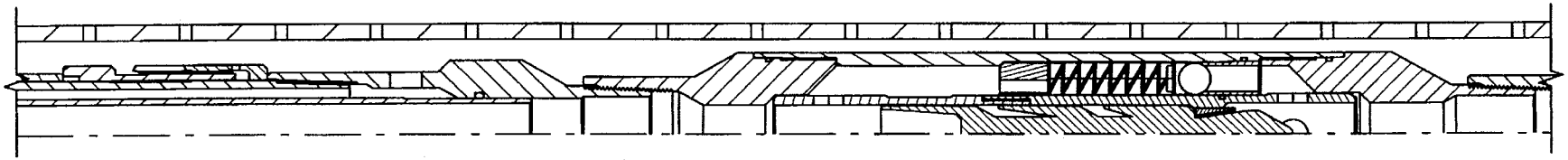
Figure 4E:
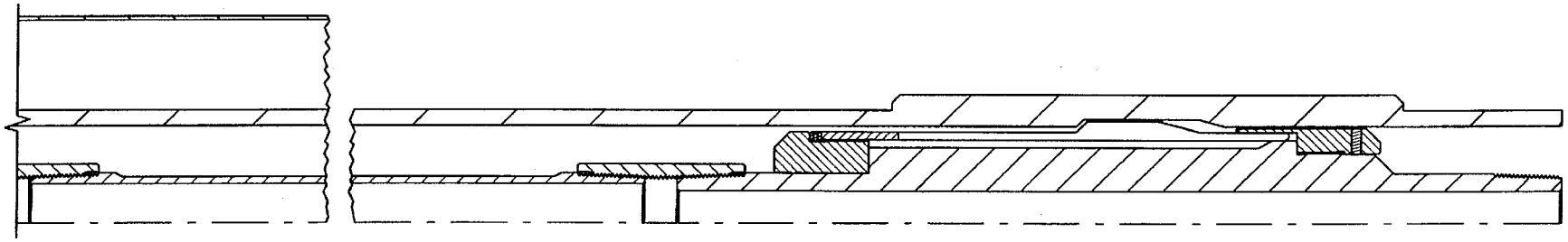
Figure 5E:
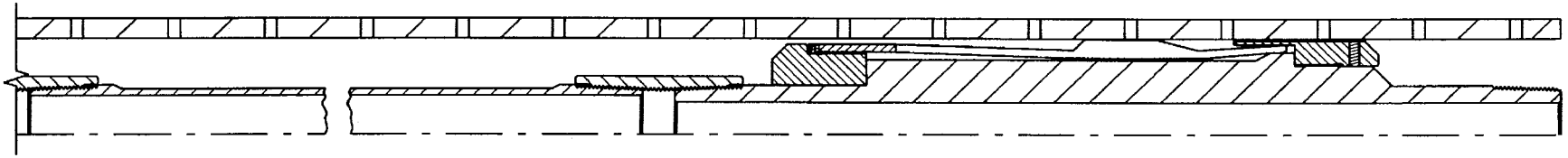
Figure 7A:
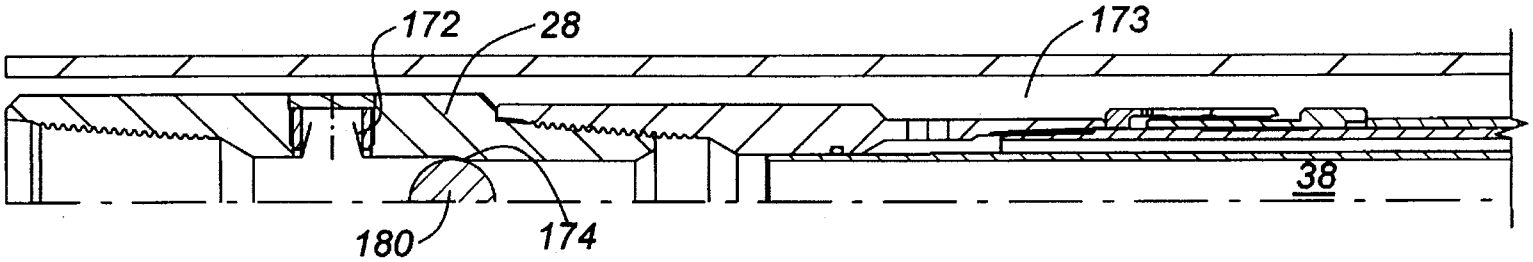
FIGS. 7*a–e* illustrate the procedure for pressure equalization in the running string to facilitate the removal of the tool after inflation of all ECPs and reversing out.
Figure 7B:
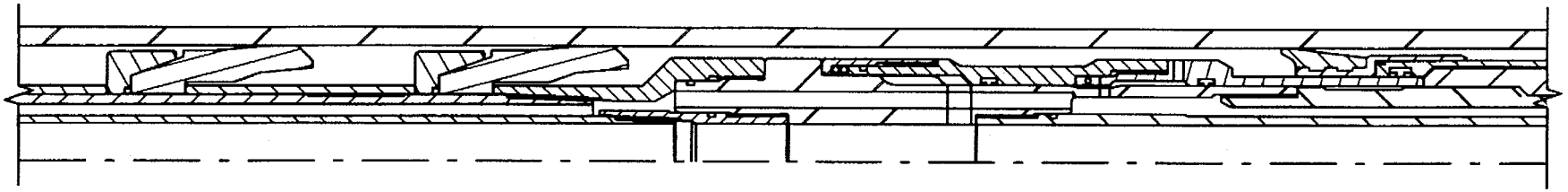
Figure 7C:
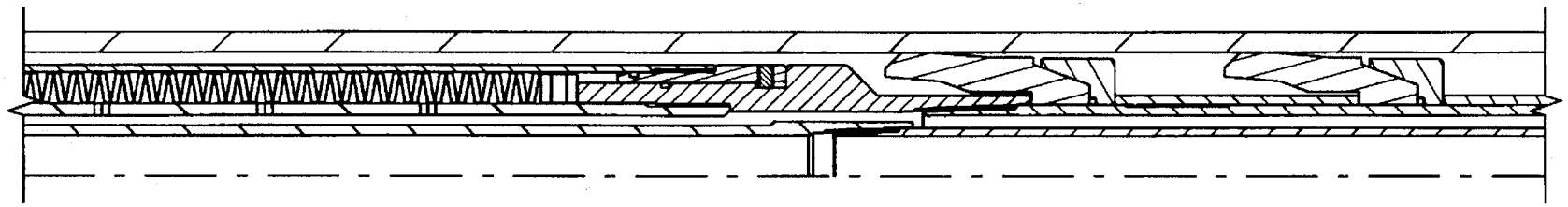

A locating mechanism 118 is connected to the apparatus A as shown in FIG. 2*e*. As shown in FIG. 3*e*, the locating mechanism 118 catches a recess 120 in the wall 100 of ECP body 96 or in the liner immediately adjacent thereto in order to properly locate seals 86 and 88 straddling opening 122 in the ECP wall 100 (see FIG. 3*b*).

Figure 8:
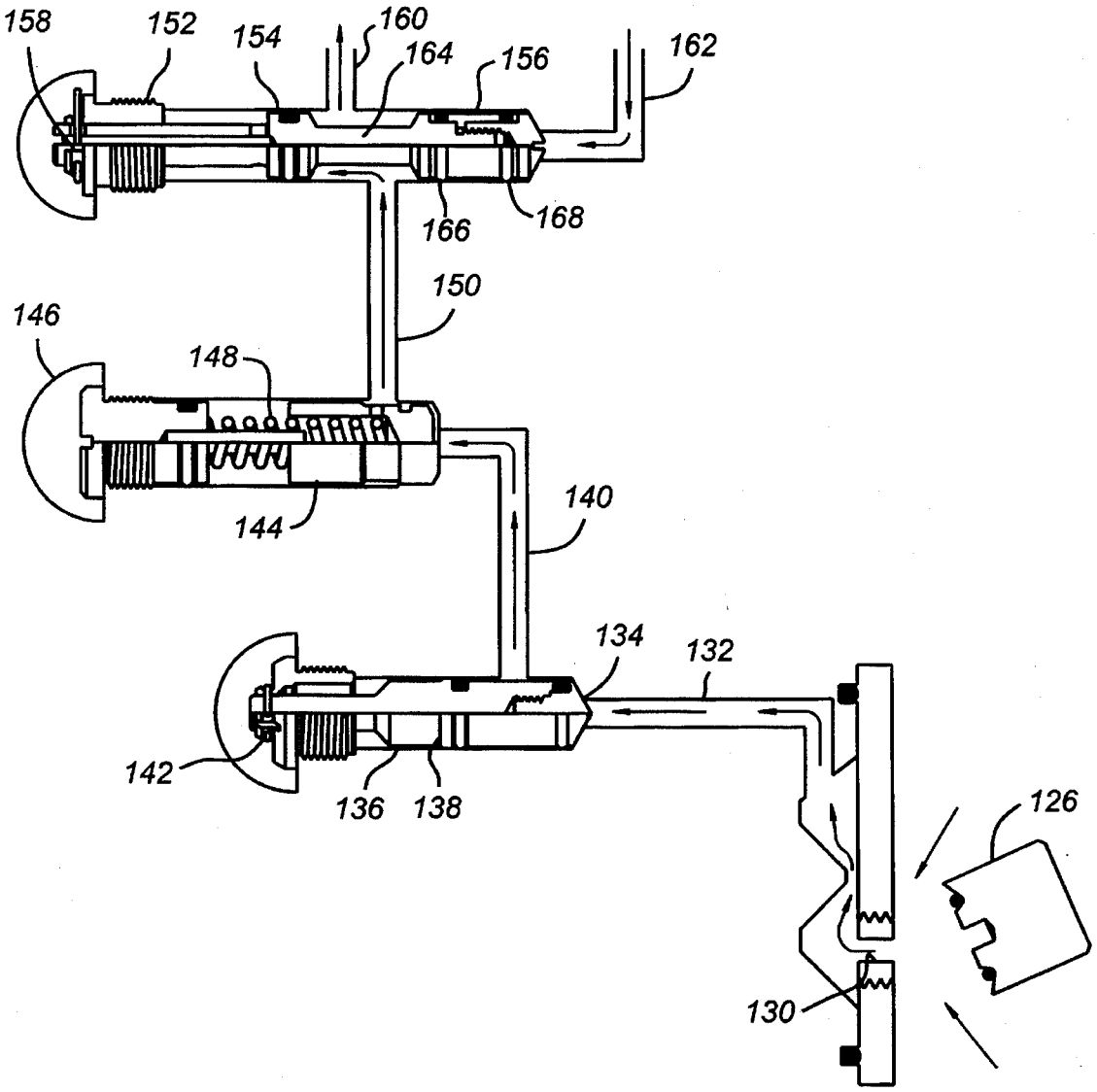
(PRIOR ART) FIG. 8
FIG. 8 is a schematic of the internal valving of a typical ECP.

The ECP 96 has an inflatable element 124 which, upon application of pressure through opening 122, results in an inflated element as shown in FIGS. 1 and 4. Referring now to FIG. 8, a schematic illustration of a possible internal ECP configuration is illustrated. In one potential application, a knock-off plug 126 can be supplied which is in some applications knocked off by a wiper plug such as plug 104. In the preferred design, a knock-out plug 126 is not employed; instead, piston 64 effectively covers variable-volume cavity 58 until predetermined pressure conditions are met. This, in turn, shifts piston 64 from the position shown in FIG. 3 to the position shown in FIG. 4. As shown in FIG. 4*b*, seals 62 have come away from surface 128, exposing a clear flowpath from cavity 58 through annular space 92 and into opening 122, which, in turn, communicates with the inlet to the ECP shown schematically as 130 in FIG. 8. Internally, the ECP has a passageway 132 leading into the inlet 134 of delay open valve 136. Delay open valve 136 is nothing more than a piston 138 which initially blocks passage 140 from passage 132. Once sufficient pressure is built-up in passage 132, a shear pin 142, which may be a pin or a wire, breaks, allowing the piston 138 to shift to align passages 132 and 140. At that time, the flow is directed to a piston 144 in check valve 146. The spring 148 is compressed, allowing passage 140 to align itself with passage 150. Passage 150 is connected to the inflate limit valve 152. Inflate limit valve 152 has pistons 154 and 156 which, in the initial position, are secured by a shear wire 158 and align the passage 150 to the element 124 through passage 160. Eventually, the element 124 inflates and pressure begins to build in return passage 162, which comes back from the element 124. Since piston 156 has a greater surface area exposed to passage 162 than the surface area exposed to the annular space between pistons 154 and 156 around connecting rod 164, the assembly of pistons 154 and 156 translates toward the shear wire 158. The translational movement of pistons 154 and 156, of course, shears the shear wire 158. Eventually, piston 156, which has seals 166 and 168, winds up in the position where seals 166 and 168 straddle passage 150 to prevent any further pressure transmission from passage 150 into passage 160. In this manner, the inflate limit valve 152 keeps the element 124 from overinflating. This can be particularly important if, for any reason, there has been a washout of the formation 26 adjacent to where the element 124 is inflating. The valve 152 ensures that the element 124 is not overpressured in that situation as well as in others.

As seen in FIGS. 2–7*a*, the top sub 28 has a lateral passage 170, which is initially obstructed by a rupture disc 172. This disc 172 is ruptured in the procedure shown in FIG. 7 to facilitate equalization of pressure within passage 38, internally of the apparatus A, to the annular space 173, outside the apparatus A, to facilitate removal of the tubing string or coiled tubing from the wellbore without having to lift the weight of the liquid or fluid in the running string or coiled tubing down to top sub 28. In the event for any reason the rupture disc 172 fails to rupture on pressure build-up due to a failure of a seal in the area of wiper plug 104 or ball 112 on seat 116, or cup seals 84–90, as shown, respectively, in FIGS. 4*d*, then a ball 180 can be dropped onto a seat 174 to obstruct the passage 38 to allow subsequent pressurization from the surface to break rupture disc 172.

All the principal parts of the apparatus A now having been described, its operation will now be reviewed in detail. The apparatus A is lowered into the existing casing or liner 10, as shown in FIG. 1, in conjunction with a liner hanger 20, or it may be separately inserted afterward. The apparatus A may be part of the assembly that is already suspended to the liner hanger 20 such that when the liner hanger 20 is actuated into attachment to the cemented liner 10, the apparatus A can then be regrabbed or properly positioned for inflation of the ECPs 18. Alternatively, the slotted casing or liner 16, with a liner hanger 20, can be separately run into the cemented casing or liner 10 and secured thereto. Thereafter, in a separate trip into the wellbore, the apparatus A can be inserted through the liner hanger 20 and properly positioned for ECP inflation. In the preferred embodiment, the lowermost ECP 18 in the wellbore is inflated first. However, the apparatus A is capable of inflating the ECPs 18 in a different order without departing from the spirit of the invention.

As shown in FIG. 2, the apparatus A is run through the slotted liner 16 until, as indicated in FIG. 3*e*, the locating mechanism 118 comes into alignment with a groove 120. At that point, the driller can pick up at the surface and encounter some resistance to know that the engagement reflected in FIG. 3*e* has occurred. When this occurs, the apparatus A is positioned in the manner illustrated in FIG. 3*b*, with lateral opening 122 positioned between seals 86 and 88. In essence, opening 122 to the ECP 18 which has the inflatable element 124 has now been placed in the position shown in FIG. 3*d*. At this point, piston 64 still effectively covers the annular passage 92 in view of seal 62 still being engaged to surface 128. However, as the wiper plug 104 is landed and securely engaged on teeth or gripping device 102 (see FIG. 4*d*), pressure may begin to be built up in passageway 38, which communicates through passageway 56 to create a force downwardly on piston 64 against the force of the stack of Belleville washers 72. Eventually, there is a force imbalance on piston 64, causing it to shift to compress the Belleville washers 72. As the piston 64 shifts, seal 82 moves beyond passage 80, effectively isolating passage 78 from bypass passage 68 (see FIG. 4*b*). Accordingly, when piston 64 shifts, passage 56 becomes aligned with passage 122 into the ECP 18 to inflate the element 124. At the same time, to allow pressure to be transmitted through passage 122 via annular space 92, the passage 78, which had previously communicated with the bypass passage 68, is in fact isolated therefrom by the positioning of seal 82 between passage 78 and passage 80. Pressure thus builds in annular space 92, which may be fully captured by wiper 98 in the ideal situation, and if not, seals 88 and 90 help contain any developed pressure which gets beyond wiper 98 within annular space 94. As previously stated, any built-up pressure in passage 38 cannot get around wiper plug 104 because of ball 112 seating on seat 116. Once the maximum inflation pressure is applied to element 124, the driller or other operators at the surface will detect that this condition has occurred, at which point the pressure of preferably cement used to inflate the element 124 will be removed. At this time, piston 64 is biased by Belleville washers 72 to resume the run-in position shown in FIG. 2*b*, thus closing off passage 56 to annular passage 92 with seal 62. Again, it should be noted that other fluids or materials can be used to inflate the element 124 without departing from the spirit of the invention.

Comparing FIG. 5 to FIG. 4, the apparatus A is raised to the next ECP 18. It should be noted that at the time the apparatus A is moved to position itself next to an adjacent ECP 18 that passage 78 has once again achieved fluid communication with the bypass passage 68 through opening 80. The Belleville washers 72, which had expelled fluid from compartment 74 through opening 76, again accept more fluid from the bypass passage 68 as they resume their initial position shown in FIG. 2. Thereafter, the apparatus A is positioned once again straddling an opening such as 122 on another 18 and the process is repeated as previously described. At the time of movement of the apparatus A, passages 92 and 94 are equalized with passage 68 so that there is no differential pressure across seals 84, 86, 88, and 90.

Having successfully inflated all the ECPs 18, it is then desirable to reverse flush any excess cement or other inflating material from inside the passageway 38. In order to accomplish this, drilling mud is pumped from the surface on the outside of the apparatus A in annular space 173. The mud enters passage 66 and proceeds down the bypass passage 68 to emerge at passage 70 (see FIG. 6). Having emerged from passage 70 into annular space 176 around seals 84–90, the mud flow can go around the bottom of the apparatus A and back into passage 38 (see FIG. 6*e*). The mud now flows uphole in passage 38 until it comes to lateral port 178. There may be one or more ports 178, all of which are situated below wiper plug 104. The mud flow provides an upward pressure on ball 112 which moves the ball to compress the spring 114, thereby unseating ball 112 from seat 116. The mud continues to flow around ball 112 into port 106 and back into passageway 38 around wiper plug 104. Thereafter, the mud can flow uphole through the coiled or rigid tubing connected to the top sub 28 and out to the surface. In that manner, the internals of the apparatus A, particularly the passage 38, can be effectively reversed to remove any excess inflating material. It should be noted that during the inflating procedure illustrated in FIG. 4, very little inflating material winds up entering the annular space 92. At this time, the equalizing line 78 remains closed off because of seal 82 to the bypass passage 68. After pressure in passage 38 is released, the excess pressure in annular space 92 over the well pressure seen in bypass passage 68 results in a net outflow from annular passage 92, thus expelling any cementitious material or other material used to inflate element 124 from annular passage 92. Similarly, once piston 64 closes after the inflation of element 124, as shown in FIG. 5, the cementitious or other material used to inflate the element 124 is only principally disposed in passage 56 and variable-volume cavity 58. The reversing out procedure, as illustrated above and shown in FIG. 6, effectively removes any accumulated material from these areas.

The final step is to remove the tubing string or coiled tubing from the wellbore, which is attached to the apparatus A at top sub 28. Since passage 38 is sealed off with plug 104, any attempt to bring up the coiled tubing or rigid tubing up at the surface would necessarily result in lifting up the weight of the fluid within the coiled or rigid tubing connected to top sub 28, as well as internally in passage 38 of the apparatus A. To allow equalization between the rigid or coiled tubing connected to top sub 28 and the annular space 173, a rupture disc 172 is employed to allow fluid communication from passage 38 into annular space 173 once it breaks. The driller or other surface operators simply increase the pressure in passage 38 which is sealed off by wiper plug 104. As the internal pressure builds up, ball 112 is held rigidly against seat 116 by spring 114. The resulting pressure build-up ultimately breaks rupture disc 172. If for any reason there is a leak or pressure fails to build up in passageway 38 to allow the rupture disc 172 to break, a ball seat 174 is provided in top sub 28 (see FIG. 7). A ball 180 can be dropped from the surface to sealingly land against seat 174 to obstruct passage 38 within top sub 28. Once that occurs, pressure is again built up from the surface until rupture disc 172 breaks. It should be noted that the ball-dropping procedure illustrated above is a secondary or backup pressure to the main way for breaking rupture disc 172, which comprises simply pressuring up against wiper plug 104. Once the rupture disc 172 is broken, the head of liquid or fluid within the rigid or coiled tubing above top sub 28 equalizes with the annular pressure in annular space 173 such that lifting of the apparatus A out of the wellbore does not entail the actual lifting of the fluid within the rigid or coiled tubing attached to the apparatus A.

Those skilled in the art will appreciate that the apparatus A and the techniques involved using the apparatus A give a reliable way to inflate ECPs in a nonmechanical manner. What is illustrated here is a reliable technique to provide assurance that each ECP 18 is properly inflated. Pressure across the cup seals is also equalized prior to movement of the apparatus A. The bypass feature around the wiper plug 104 facilitates reversing out so as to allow any excess inflating material, such as perhaps a cementitious material, to be reversed out to the surface through the rigid tubing or coiled tubing used to suspend the apparatus A. An equalizing feature is provided to eliminate the need to pick up the weight of liquid within the coiled or rigid tubing supporting the apparatus A by allowing equalization through the rupture disc 172. By allowing the annular space 92 to be vented to a bypass line and pressure equalized, again the useful life of the seals, particularly 88 and 90, is increased because the annular space 92 and 94 which they define in effect becomes equalized through passageway 68, with the surrounding pressure in annulus 173 before the apparatus A is moved along the wall 100. Particularly in deviated wellbores, the actuation system offers a far more reliable technique than mechanical actuations which can result in uncertainties as to whether the required downhole movement has been effectively transmitted from the surface. By making the inflation procedure of the ECP controlled by hydraulics or fluid action, the uncertainties of mechanical actuation have been eliminated. The design featuring fluid or hydraulic actuation is a more compact design, which can be easily tailored to a variety of situations. The stack of washers 72, for example, can be changed to accommodate the expected forces to be encountered in a particular application so as to keep the piston 64 in its initial or run-in position at the depths encountered and for the fluid conditions expected.

The foregoing disclosure and description of the invention are illustrative and explanatory thereof, and various changes in the size, shape and materials, as well as in the details of the illustrated construction, may be made without departing from the spirit of the invention.

I claim:

1. In combination, a tool for inflation of one or more packers in a wellbore and at least one external casing packer, said tool having an opening which is aligned with said packer for inflation thereof, comprising:

a tubular having an external casing packer mounted thereon and an inflation opening into the interior of said tubular;

said tool comprising:

a body;

a seal assembly on said body extending sufficiently upon assembly to said tubular to span an annular space between said body and said packer and seal it off around the opening into said packer;

said body formed having a passage in communication with said annular space whereupon application of pressure to said passage, said packer is inflated as said seal assembly retains the applied pressure in said annular space and facilitates its communication into the opening of said packer for fluid inflation thereof;

said body further comprises a valve member mounted to said body and movable to an open position responsive to applied pressure in said passage to selectively allow pressurization of said annular space from said body and thereafter said valve member is biased to return to a closed position upon removal of applied pressure.

2. A tool for inflation of one or more packers in a wellbore, having an opening into the packer for inflation thereof, comprising:

a body;

a seal assembly on said body to span an annular space between said body and the packer and seal it off around the opening into the packer;

said body formed having a passage in communication with said annular space whereupon application of pressure to said passage, said packer is inflated as said seal assembly retains the applied pressure in said annular space and facilitates its communication into the opening of the packer for fluid inflation thereof;

said body further comprises a valve member mounted to said body and movable between an open and closed position responsive to applied pressure in said passage to selectively allow pressurization of said annular space from said body;

said body further comprises a bypass passage which allows fluid communication from outside said body from one side of the seal assembly to an opposite side, bypassing said annular space defined by said seal assembly; and said annular space selectively in communication with said bypass passage.

3. The tool of claim 2, wherein:

said valve member is biased to said closed position and said valve member containing an equalizing port which is aligned in flow communication with said bypass passage when said valve member is in said closed position.

4. The tool of claim 3, wherein:

said body further comprises a wiper mounted to said body and extending into said annular space and in contact with the packer adjacent the opening therein.

5. The tool of claim 3, wherein:

at least one spring applies a spring force to said valve member;

said valve member, responsive to applied pressure in said passage of said body, translates to overcome an opposing spring force and, by virtue of said translation to said open position, sealingly isolates said bypass passage from said annular space and aligns said passage in said body with said annular space for inflation of the packer.

6. The tool of claim 5, wherein:

said spring biases said valve member closed and aligns said equalizing port to said bypass passage to equalize pressure on said seal assembly when pressure is removed from said passage in said body;

said valve member, when biased to said closed position, blocking said passage in said body from said annular space.

7. The tool of claim 6, wherein:

said passage in said body comprises a bore therethrough;

said body further comprises means for obstructing said bore to allow selective pressurization of said bore in a portion above said means for obstructing;

said body further comprising a bypass path around said means for obstructing with a one-way valve therein, said one-way valve allowing pressure build-up in said bore above said means for obstructing while permitting flow from below said means for obstructing to flow through said bypass path to displace inflating material above said means for obstructing, out of said body.

8. The tool of claim 7, further comprising:

a pressure-relief valve mounted to said body to allow selective flow communication from said bore, in a portion above said means for obstructing, and through said body for pressure-equalization to facilitate removal of said body from the wellbore.

9. A tool for inflation of one or more packers in a wellbore, having an opening into the packer for inflation thereof, comprising:

a body;

a seal assembly on said body to span an annular space between said body and the packer and seal it off around the opening into the packer;

said body formed having a passage in communication with said annular space whereupon application of pressure to said passage, said packer is inflated as said seal assembly retains the applied pressure in said annular space and facilitates its communication into the opening of the packer for fluid inflation thereof;

said body further comprises a valve member mounted to said body and movable between an open and closed position responsive to applied pressure in said passage to selectively allow pressurization of said annular space from said body;

said passage in said body comprises a bore therethrough;

said body further comprises means for obstructing said bore to allow selective pressurization of said bore in a portion above said means for obstructing;

said body further comprising a bypass path around said means for obstructing with a one-way valve therein, said one-way valve allowing pressure build-up in said bore above said means for obstructing while permitting flow from below said means for obstructing to flow through said bypass path to displace inflating material above said means for obstructing, out of said body.

10. The tool of claim 9, further comprising:

a pressure-relief valve mounted to said body to allow selective flow communication from said bore, in a portion above said means for obstructing, and through said body for pressure-equalization to facilitate removal of said body from the wellbore.

11. A method of inflating at least one external packer mounted on a casing or liner, comprising:

positioning an inflating tool adjacent an opening leading into the packer;

isolating the opening with a sealing system that straddles the opening;

applying fluid pressure to operate a valve on said inflation tool to open said valve and to inflate the packer;

removing fluid pressure to allow said valve to be biased to a closed position.

12. A method of inflating at least one external packer mounted on a casing or liner, comprising:

positioning an inflating tool adjacent an opening leading into the packer;

isolating the opening with a sealing system seals that straddles the opening;

obstructing a bore in the tool;

building fluid pressure within the tool against said obstruction;

applying said fluid pressure to operate a valve to inflate the packer;

moving said valve against a biasing force with said fluid pressure;

providing an equalizing passage around said sealing system which passes through the tool;

isolating said equalizing passage, from an annular space defined by said seals while straddling said opening, by virtue of said valve movement; and applying fluid pressure into said annular space.

13. The method of claim 12, further comprising the steps of:

removing said built-up pressure;

biasing said valve in a second direction opposite said first direction to isolate said bore from said annular space between said seals and venting pressure in said annular space to said bypass passage.

14. The method of claim 13, further comprising the step of:

using a wiper between said seals to reduce the volume of said annular space which communicates with said opening in the packer.

15. The method of claim 13, further comprising the steps of:

pumping through said equalizing passage and into the lower end of the tool below said obstruction;

providing a one-way bypass passage in the tool around said obstruction;

continuing flow up through the tool around said obstruction to flush inflating fluid located above said obstruction from the tool to the surface.

16. The method of claim 15; further comprising the steps of:

equalizing pressure from inside to outside the tool;

removing the head of fluid in the tubing or string connected to said tool by said equalizing;

removing the tool from the wellbore.

17. The method of claim 16, further comprising the steps of:

accomplishing said equalizing by a pressure build-up from the surface against said obstruction and said one-way bypass passage;

breaking a rupture disc with said pressure build-up.

18. The method of claim 17, further comprising the steps of:

providing a ball seat around said bore in the tool above said obstruction;

dropping a ball to land on said ball seat which is located above said obstruction and said one-way bypass passage and below said rupture disc as a back-up measure if said obstruction and a one-way valve in said bypass passage fail to hold pressure for breaking of said rupture disc.

19. The method of claim 12, further comprising the steps of:

pumping through said equalizing passage and into the lower end of the tool below said obstruction;

providing a one-way bypass passage in the tool around said obstruction;

continuing flow up through the tool around said obstruction to flush inflating fluid located above said obstruction from the tool to the surface.

20. The method of claim 19, further comprising the steps of:

equalizing pressure from inside to outside the tool;

removing the head of fluid in the tubing or string connected to said tool by said equalizing;

removing the tool from the wellbore.

21. The method of claim 20, further comprising the steps of:

accomplishing said equalizing by a pressure build-up from the surface against said obstruction and said one-way bypass passage;

breaking a rupture disc with said pressure build-up.

22. The method of claim 21, further comprising the steps of:

providing a ball seat around said bore in the tool above said obstruction;

dropping a ball to land on said ball seat which is located above said obstruction and said one-way bypass passage and below said rupture disc as a back-up measure if said obstruction and a one-way valve in said bypass passage fail to hold pressure for breaking of said rupture disc.

23. A pressure-actuated downhole tool positioned on a string or coiled tubing from the surface and into a wellbore, said string or coiled tubing defining an annulus in the wellbore, comprising:

an elongated body having a passage therethrough and an upper end connected to the tubing or string;

a plug for selectively obstructing said passage when dropped into said body through said tubing or string, whereupon said tool can be actuated by internal pressure build-up from the surface;

a bypass passage in said body around said plug in said passage, further comprising a one-way valve mounted therein, said one-way valve facilitating pressure build-up in said body from the surface against said plug and said one-way valve and permitting reverse flow from the annulus down around said tubing or string, and into said passage under said plug and passing through said one-way valve and to the surface through said tubing or string.

24. A pressure-actuated external packer inflating tool, adapted to be run into a wellbore from the surface on tubing or a tubing string, comprising:

a body externally sealingly positionable adjacent the packer;

a plug selectively insertable into said body to obstruct a passage therein, said body having a port above said plug when said plug is inserted into said body, said port in fluid communication with the packer when the tool is sealingly positioned adjacent thereto, said plug facilitating internal pressure build-up from the surface to inflate the packer;

a bypass passage in said body extending, on both ends, into said passage in said body and around said plug and further comprising a one-way valve therein;

whereupon pressure build-up from the surface is possible against said one-way valve and said plug, and reverse flow into said passage of said body from below said plug bypasses around said plug for facilitating removal of inflating material from said body.

* * * * *